US008384581B2

(12) United States Patent
Matthews et al.

(10) Patent No.: US 8,384,581 B2
(45) Date of Patent: Feb. 26, 2013

(54) REDUCING RADAR SIGNATURES

(75) Inventors: James Christopher Gordon Matthews, Chelmsford (GB); Per Sveigaard Mikkelsen, Randers SV (DK)

(73) Assignee: BAE Systems PLC, London (GB)

( * ) Notice: Subject to any disclaimer, the term of this patent is extended or adjusted under 35 U.S.C. 154(b) by 338 days.

(21) Appl. No.: 12/306,520

(22) PCT Filed: Oct. 24, 2008

(86) PCT No.: PCT/GB2008/003632

§ 371 (c)(1),
(2), (4) Date: Jun. 15, 2010

(87) PCT Pub. No.: WO2009/053722

PCT Pub. Date: Apr. 30, 2009

(65) Prior Publication Data

US 2010/0253564 A1 Oct. 7, 2010

(30) Foreign Application Priority Data

Oct. 26, 2007 (EP) ..... 07270063
Oct. 26, 2007 (GB) ..... 0721004.0

(51) Int. Cl.
*H01Q 15/00* (2006.01)

(52) U.S. Cl. ..... 342/5; 416/214 R

(58) Field of Classification Search ..... 342/1–5, 342/159; 416/241 R
See application file for complete search history.

(56) References Cited

U.S. PATENT DOCUMENTS 4,034,372 A * 7/1977 Margerum ..... 342/15
4,308,882 A 1/1982 Pusch et al.
5,028,928 A * 7/1991 Vidmar et al. ..... 342/10
5,250,950 A 10/1993 Scherrer et al.
5,296,859 A * 3/1994 Naito et al. ..... 342/1
5,337,016 A * 8/1994 Wozniak et al. ..... 324/632
5,488,372 A * 1/1996 Fischer ..... 342/5

(Continued)

FOREIGN PATENT DOCUMENTS

FR 2 736 160 1/1997
FR 2930601 A1 * 10/2009

(Continued)

OTHER PUBLICATIONS

Technology: Green Tech: Taking turbines off the radar: The big, fast-moving blades at modern wind farms clutter up air navigation. But 'stealth' technology could solve the problem, Alok Jha. The Guardian. London (UK):Oct. 29, 2009. p. 6.*

(Continued)

*Primary Examiner* — John B Sotomayor
(74) *Attorney, Agent, or Firm* — Kenyon & Kenyon LLP

(57) ABSTRACT

A structure and a method for modifying an existing design of structure are provided, wherein the structure is provided to at least partially enclose an object that has a large radar cross section. The structure comprises a non-metallic portion having a radar-reflective layer applied to an inclined surface of the structure. The inclined surface is arranged with one or more angles of inclination selected so that the radar cross-section for the structure has a value that is lower than that for the object enclosed in one or more frequency ranges. In a preferred variation, an at least partially detached and appropriately shaped radar-reflective structure may be provided as an alternative to or to supplement the modification of an existing enclosure.

14 Claims, 7 Drawing Sheets

U.S. PATENT DOCUMENTS

| | | | | |
|---|---|---|---|---|
| 5,708,435 | A * | 1/1998 | Kudo et al. | 342/1 |
| 6,107,952 | A | 8/2000 | Barker et al. | |
| 7,212,147 | B2 * | 5/2007 | Messano | 342/4 |
| 8,174,139 | B1 * | 5/2012 | Parsche et al. | 290/44 |
| 2003/0052833 | A1 | 3/2003 | Chang et al. | |
| 2004/0119629 | A1 | 6/2004 | Hinsverk | |
| 2004/0257260 | A1 | 12/2004 | Breeden et al. | |
| 2008/0101930 | A1 * | 5/2008 | Bosche | 416/31 |
| 2009/0047116 | A1 * | 2/2009 | Barbu et al. | 415/1 |
| 2009/0121491 | A1 * | 5/2009 | Mikkelsen | 290/55 |
| 2009/0202347 | A1 * | 8/2009 | Rugger | 416/31 |
| 2010/0166547 | A1 * | 7/2010 | Presz et al. | 415/200 |
| 2010/0231434 | A1 * | 9/2010 | Pinto et al. | 342/4 |
| 2010/0253564 | A1 * | 10/2010 | Matthews et al. | 342/4 |
| 2011/0260908 | A1 * | 10/2011 | New et al. | 342/59 |
| 2011/0291908 | A1 * | 12/2011 | Hook | 343/841 |
| 2012/0093658 | A1 * | 4/2012 | Appleton et al. | 416/241 R |
| 2012/0107553 | A1 * | 5/2012 | Appleton et al. | 428/136 |

FOREIGN PATENT DOCUMENTS

| | | |
|---|---|---|
| GB | 2 247 357 | 2/1992 |
| GB | 2 303 741 | 2/1997 |
| GB | 2458998 A * | 10/2009 |
| RU | 2 101 658 | 1/1998 |
| WO | WO 97/07558 | 2/1997 |
| WO | WO 01/09562 | 2/2001 |
| WO | WO 2005/020373 | 3/2005 |
| WO | WO 2008/035038 | 3/2008 |

OTHER PUBLICATIONS

A high tech solution to wind turbine problems :Problems for aviation radar caused by wind turbines could soon be alleviated—thanks to a Scunthorpe business. Anonymous. Scunthorpe Evening Telegraph. Scunthorpe (UK):Jan. 20, 2009. p. 3.*

Turbines to get stealthy, James Randerson. New Scientist. London:Aug. 9, 2003. vol. 179, Iss. 2407, p. 6.*

Detection and mitigation of wind turbine clutter in C-band meteorological radar, Gallardo-Hernando, B.; Pérez-Martinez, F.; Aguado-Encabo, F.. IET Radar, Sonar and Navigation 4. 4 (Aug. 1, 2010): 520-527.*

European Patent Office, International Search Report and Written Opinion, Jan. 20, 2009, from International Patent Application No. PCT/GB2008/003632, filed on Oct. 24, 2008.

European Patent Office, International Preliminary Report on Patentability, May 6, 2010, from International Patent Application No. PCT/GB2008/003632, filed on Oct. 24, 2008.

U.K. Patent Office, Search Report, Feb. 11, 2008, from related UK Patent Application No. GB 0721004.0, filed on Oct. 26, 2007.

European Patent Office, Search Report, Jun. 10, 2008, from related European Patent Application No. 07270063.6, filed on Oct. 26, 2007.

* cited by examiner

REDUCING RADAR SIGNATURES

This invention relates to techniques for reducing the radar signature of an at least partially enclosed object which conventionally has a large radar signature. In particular, but not exclusively, this invention relates to an enclosing structure and to techniques for modifying non-metallic full or partial enclosing structures to provide an overall reduction in the radar cross-section (RCS) over that of an object when not thereby enclosed.

The magnitude with which a particular object scatters radar energy is characterised in terms of its radar cross section (RCS). The RCS of an object is dependent on the size and shape of the object and on the material from which it is made. In respect of a particular radar installation, the RCS of an object is also dependent on the relative positions of the transmitting and receiving antenna apertures of the installation, and on the angle of polarisation of a transmitted electromagnetic (EM) wave incident on the object.

In an international patent application by the present Applicant, application number PCT/GB2007/003448, a structure is described having a reduced RCS in one or more different frequency bands, achieved by setting the angle of an inclined surface of the structure to one at which a reduced level of RCS occurs due to the sidelobes in the scattering pattern of incident electromagnetic radiation at such frequencies. Although not limited to such structures, the invention in that case is of greatest benefit when applied to structures constructed using materials that are highly reflective of electromagnetic radiation.

From a first aspect, the present invention resides in a structure for at least partially enclosing an object, wherein the structure comprises a non-metallic portion having a radar-reflective layer applied to an inclined surface of the structure, wherein the inclined surface is arranged with one or more angles of inclination selected so that the radar cross-section for the structure has a value that is lower than that for the object in one or more frequency ranges.

The structures described in the present applicant's earlier patent application, referenced above, are typically highly reflective of radar signals, for example because they are constructed from metal. However, the method for determining RCS-reducing shapes for the structures described therein may be applied to other types of structure which conventionally do not themselves have a large RCS, e.g. because they are non-metallic, but which may be enclosing something that does have a large RCS, such as a large piece of equipment which is not susceptible to shaping according to that invention. Whereas shaping of such a low-RCS enclosing structure would have relatively little effect in reducing the overall RCS of the enclosure and, in particular, of the object enclosed, if the enclosing structure is first provided with a radar-reflective layer then the enclosure itself would become the dominant feature as regards radar signature and would be susceptible to the benefits of shaping. In particular, shaping is likely to reduce the RCS of the modified enclosure to a value less than that for the object that it encloses.

Preferably, the radar-reflective layer is provided by a metal foil applied to the inclined surface of the non-metallic portion of the structure, preferably to an interior surface of the structure. A metallic layer comprising a metal foil is easily applied, is inexpensive and does not add greatly to the weight of the structure.

In a preferred embodiment, the radar-reflective layer further comprises a metallic portion at least partially detached from the non-metallic portion of the structure and the metallic portion is provided with a surface inclined at one or more angles of inclination selected so that the radar cross-section for the structure has a value that is lower than that for the object in the one or more frequency ranges. This provides an alternative means for providing a metallic portion of a structure where the non-metallic portion of the structure cannot be shaped appropriately, e.g. because of aerodynamic constraints or "must-fit" requirements.

Preferably, the metallic portion is provided on an interior side of the structure.

In a further preferred embodiment, a radar-reflective structure with an appropriately inclined surface may be provided within a non-metallic enclosure wherein the radar-reflective structure is entirely detached from the non-metallic enclosure. Advantageously, provision of a separate detached radar-reflective structure inside an existing non-metallic enclosure would not involve any modifications to the non-metallic enclosure. Such a detached radar-reflective structure may be suspended and supported using ties attached to the interior surface of the enclosure. The detached structure may comprise a very light-weight material with a metallic coating, for example a flexible fabric, that may be suspended and held under tension by the ties, in the manner of a tent, or made self-supporting with a light-weight supporting structure which may be integrated with the fabric.

There may be practical or aesthetic reasons for preserving the shape of an existing non-metallic enclosure, for example where the enclosure is a component of a larger structure or where its shape has been determined by other constraints such as streamlining. In these cases the provision of a separate shaped inner metallic enclosure is likely to be of particular benefit.

In a preferred embodiment, at least one of the one or more angles of inclination is selected to correspond to an angle for which the value for radar cross-section of the structure substantially corresponds to a local minimum in the pattern of sidelobes formed in a scattering pattern of incident electromagnetic radiation in at least one of the one or more frequency ranges.

This provides for a further potential reduction in RCS of the structure by exploiting local minima in the scattering pattern. Whereas it may be possible to select an angle of inclination to exploit a local minimum in the scattering pattern for one frequency range, in general the reduced value of RCS achievable is likely to correspond substantially to a local minimum value for the mean RCS across two or more frequency ranges.

From a second aspect, the present invention resides in a method for modifying an at least partial enclosure for an object, wherein the at least partial enclosure presents a relatively small radar cross-section in comparison with that of the object, the method for modifying comprising applying a radar-reflective layer to the at least partial enclosure and providing the enclosure with an inclined surface inclined at one or more angles of inclination selected so that the radar cross-section of the at least partial enclosure, so modified, has a value that is lower in comparison with that of the object in one or more frequency ranges.

In a preferred embodiment the enclosure is non-metallic and applying a radar-reflective layer comprises applying a layer of metal foil to the inclined surface of the at least partial enclosure, preferably to an interior surface of the non-metallic enclosure.

In a further preferred embodiment, the enclosure is non-metallic and applying a radar-reflective layer comprises providing a radar-reflective structure at least partially detached from the non-metallic enclosure, wherein the radar-reflective structure is provided with a surface inclined at one or more angles of inclination selected so that the radar cross-section of the at least partial enclosure, so modified, has a value that is lower in comparison with that of the object in the one or more frequency ranges.

For further potential refinement in reducing the RCS of the enclosure, at least one of the one or more angles of inclination is selected to correspond to an angle for which the value for radar cross-section of the structure, so modified, substantially corresponds to a local minimum in the pattern of sidelobes formed in a scattering pattern of incident electromagnetic radiation in at least one of the one or more frequency ranges.

From a third aspect, the present invention resides in a nacelle for a wind turbine, comprising a non-metallic portion having an inclined surface to which a radar-reflective layer has been applied, wherein the inclined surface is arranged with one or more angles of inclination selected so that the radar cross-section for the nacelle has a value that is lower than that for equipment enclosed by the nacelle in one or more frequency ranges.

Preferably, the radar-reflective layer is provided by a metal foil applied to the inclined surface.

In a preferred embodiment, the radar-reflective layer further comprises a radar-reflective portion at least partially detached from the non-metallic portion of the nacelle and wherein the radar-reflective portion is provided with a surface inclined at one or more angles of inclination selected so that the radar cross-section for the nacelle has a value that is lower than that for the enclosed equipment in the one or more frequency ranges.

This preferred technique for applying a radar-reflective lining to a non-metallic structure in order to increase the effectiveness of shaping in providing a reduced overall RCS is particularly applicable to a wind turbine in which a generator is often housed in a non-metallic nacelle. Whereas it would be impractical to shape the generator to minimise its RCS, and whereas shaping alone would be largely ineffective given that the nacelle is non-metallic and thus presents a relatively low RCS in itself, if the nacelle were shaped and lined with a metallic foil lining, or if an at least partially separate inner metallic enclosure were provided which has been shaped, according to the present invention, then the RCS presented would be that of the shaped and lined nacelle or of the shaped inner metallic enclosure rather than that of the generator, with an overall reduction in RCS.

In any situation in which there may be practical difficulties in shaping a structure, the structure may be shrouded by an appropriately designed enclosure according to preferred embodiments of the present invention and, if non-metallic, the enclosure may be lined with metal to increase the effectiveness of the shaping in reducing its RCS.

Preferred embodiments of the present invention will now be described in more detail, by way of example only, with reference to the accompanying drawings of which:

A preferred shaping technique for determining an angle of inclination for an inclined surface of a structure, for example of a tower, to reduce or substantially minimise the RCS of the structure, has been described in the earlier international patent application by the present Applicant, number PCT/GB2007/003448, referenced above. The description of that preferred technique has been reproduced below for completeness. However, it will be clear to a person of ordinary skill in this field of technology that the technique described may be applied with little modification to the shaping of radar-reflective structures other than towers.

For the purposes of the present invention, the preferred shaping technique will be applied to the problem of reducing the RCS of an object which is not itself susceptible to shaping. An example from the wind turbine field of such an object may be a generator housed in the nacelle of a wind turbine. An enclosure would typically be provided to give environmental protection to the object. A representation of such an arrangement is shown in FIG. 1.

Figure 1:
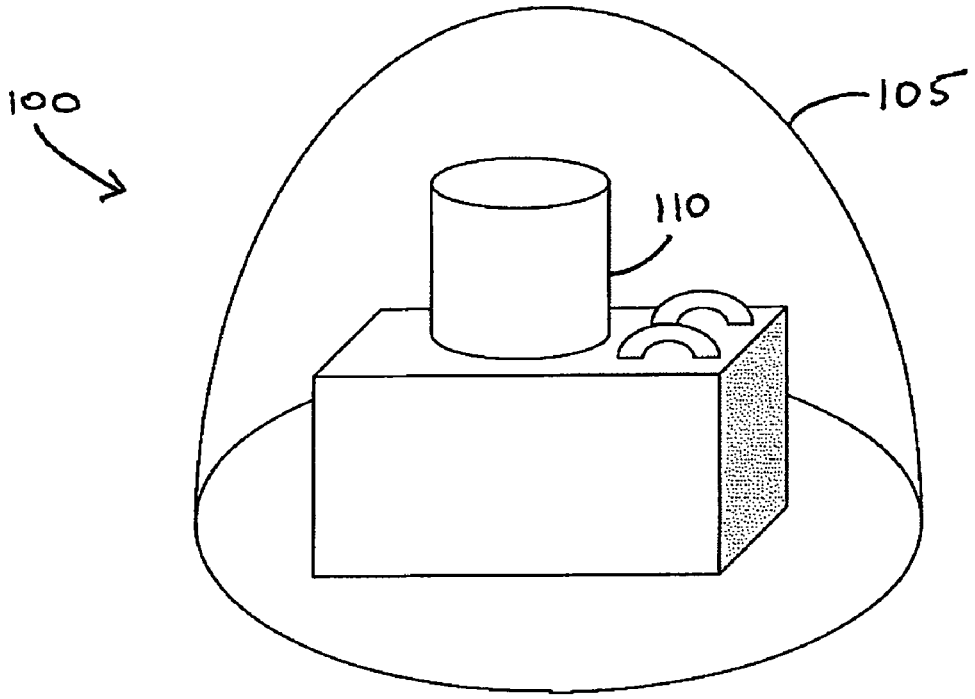
FIG. 1 is a representation of an object having a large radar cross-section housed inside a non-metallic enclosure.

Referring to FIG. 1, a non-metallic enclosure 105 is shown housing an object 110 with a large RCS. The object may be any large piece of equipment likely to be located within the field of view of a radar installation. The enclosure 105 may be made from a material such as glass fibre, providing a strong but lightweight structure that is inexpensive to make. The non-metallic enclosure 105 is substantially transparent to incident electromagnetic radiation and therefore contributes little to the overall RCS of the complete arrangement 100 of the enclosure 105 and the object 110 enclosed. Thus shaping of the enclosure 105 would not itself provide a significant reduction in the overall RCS seen by the radar installation.

According to a first preferred embodiment of the present invention, the design of the enclosure 105 may be modified in two ways while enabling it to continue to function as an enclosure for the object 110, as will now be described with reference to FIG. 2.

Figure 2:
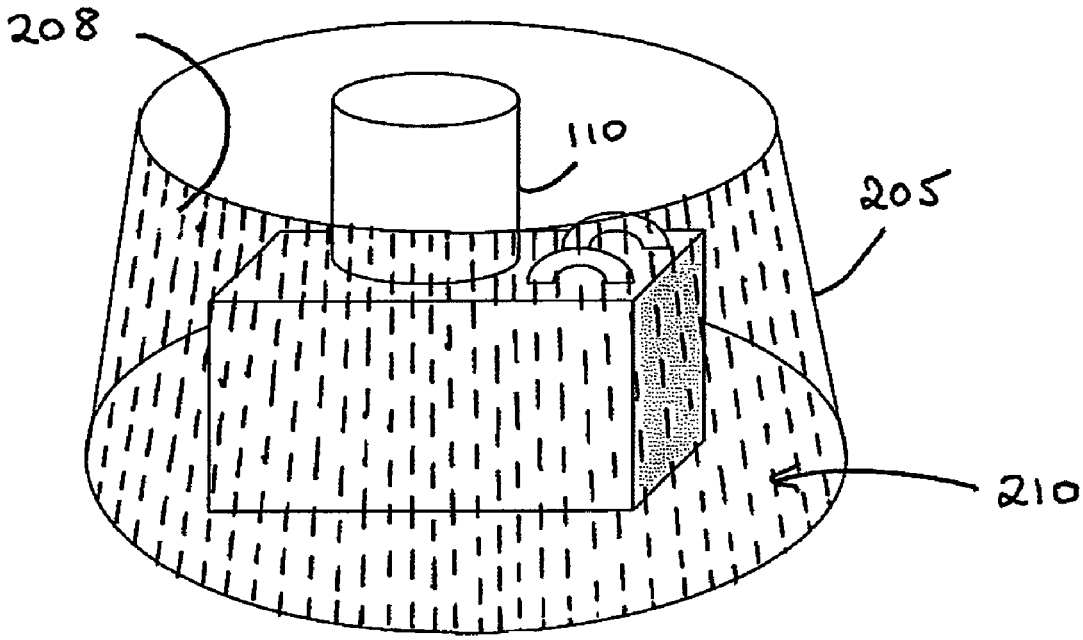
FIG. 2 is a representation of an object having a large radar cross-section housed inside an enclosure whose design has been modified according to a preferred embodiment of the present invention.

Referring to FIG. 2, the object 110 is shown enclosed by an enclosure 205 modified according to this first preferred embodiment of the present invention. Firstly, the non-metallic enclosure is lined at least in part with a metal foil 208 to render it highly reflective of incident electromagnetic radiation. Secondly, the foil lined enclosure 205 is shaped according to the technique described below to provide it with a surface 210 inclined at an angle of inclination selected to provide an overall RCS for the enclosure 205 that is lower than that for the object 110 enclosed. The shaping step results, in this example, in an enclosure 205 in the shape of a truncated cone (a frustum). The addition of the metal foil lining 208 renders the otherwise non-metallic enclosure 205 highly susceptible to the benefits of appropriate shaping to give a significantly reduced RCS in one or more frequency bands, for example in the two main radar frequency bands used in the UK.

In many cases, where there is a design for an existing non-metallic enclosure, the modifications made to the shape of the enclosure for the purposes of the present invention may be minimal and may be arranged to substantially satisfy other design or cost constraints placed upon the provision of such an enclosure. Furthermore, the addition of a metallic foil lining may be performed inexpensively and add very little weight to the enclosure.

A second embodiment of the present invention will now be described with reference to FIG. 3 in which an enclosure is not itself susceptible to modification, for example as for the first embodiment described above.

Figure 3:
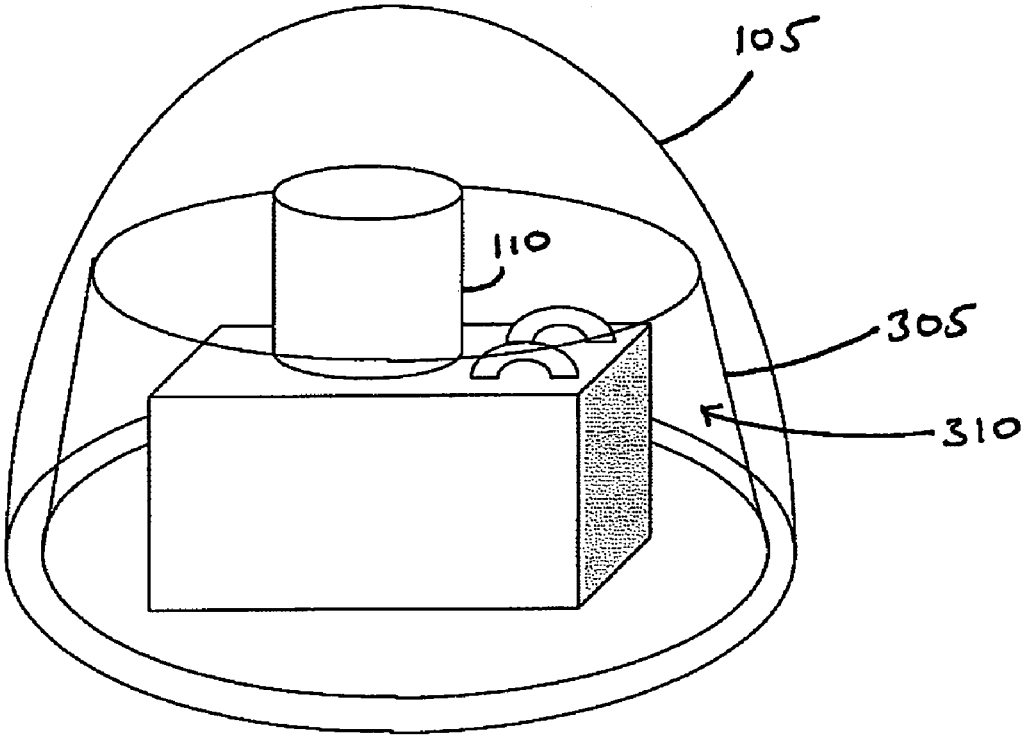
FIG. 3 is a representation of an object having a large radar cross-section housed inside a non-metallic enclosure provided with a supplementary inner radar-reflective enclosure according to a further preferred embodiment of the present invention.

Referring to FIG. 3, the unmodified non-metallic enclosure 105 and the object 110 enclosed are assumed for the purposes of this example to be the same as those in the arrangement shown in FIG. 1, with the limitation that the shape of the enclosure 105 is to be maintained. In this second preferred embodiment of the present invention, a separate metallic structure 305 is provided inside the enclosure 105, preferably detached from it, so that an additional enclosure—a metallic enclosure—is provided for the object 110. The metallic structure 305 has in this example been shaped to form a truncated cone (a frustum) similar in shape to that of the modified enclosure 205 shown in FIG. 2. The angle of inclination of the inclined surface 310 of the metallic structure 305 has been chosen, as for the first embodiment, so that the RCS of the metallic structure 305 is lower in value than that of the object 110. Thus the addition of the inner metallic structure 305 has resulted in a lower overall RCS for the enclosed object 110 but with the advantage that the original non-metallic enclosure 105 has not been modified in any way.

The separate metallic structure 305 does not generally need to be a substantial structure. The only requirement is that it is sufficiently radar-reflective for its shape to effective in providing a reduced RCS. The separate structure 305 may for example be made from a lightweight non-metallic material with a metallic coating and may be suspended and supported by means of ties to the inner surface of the enclosure 105, so requiring no structural rigidity of its own. The structure 305 may take the form of a tent-like structure made from a flexible fabric that has been coated with a metallic coating. The fabric may be held taught by the above-mentioned ties, or it may be self-supporting, in the manner of a tent, with a light-weight structure integrated with the fabric. Such a structure may also be inflatable or supported by an increased air pressure.

Of course, the enclosure 105 may be only partially modified, for example to provide a metal foil lining only to a part of the enclosure 105 that is already provided with an appropriately inclined surface. Preferably, a supplementary metallic structure may be provided inside the enclosure, but detached from it, to provide an appropriately inclined metallic surface to supplement the partially modified enclosure. Typically, the supplementary metallic structure is designed to enclose only that part of an object 110 not enclosed, from the perspective of a radar installation, by the partially modified part of the enclosure 105.

Whereas the modified enclosure 205 and the separate metallic structure 305 are shown to have axially symmetric shapes, in this example a frustum, which may be useful in event that the structures are in the field of view of several radar installations from different directions, the structures 205, 305 may in practice be shaped in respect of a single radar installation only. In that case, the structures 205, 305 may have an "almond" or other asymmetrical shape, where the appropriately inclined surfaces are substantially on the radar-facing sides of the structures and the other sides may be shaped according to other criteria.

The technique for determining the angle of inclination of an inclined surface for modified enclosures, or for at least partially detached metallic structures, will now be described. This technique is based upon the example of a tower-like structure, although it will be clear to a person of ordinary skill in this field that the technique may equally well be applied to more truncated structures suitable for use as enclosures, without substantial modification to the technique.

Tower-like structures, for example a wind turbine tower, are known to present a very large radar signatures, being approximately 80 meters tall. The inventors in the present case have modelled the electromagnetic properties of such a tower using a BAE SYSTEMS plc proprietary physical optics computer program called "MITRE". The MITRE software was used to evaluate the monostatic (i.e. the transmit and receive radar antennas are collocated) radar cross-section (RCS) of a typical tower at 3 GHz in order to predict the magnitude of backscatter from the object. A commercially available hybrid computer program product called "FEKO" was used to perform the same evaluation of the tower at 10 GHz. These frequencies were selected to correspond to those of the radars of the major UK operators which may be broken down into two distinct bands: 2.7-3.1 GHz, covering air defence, civil and military air traffic control primary surveillance radars, and marine Vessel Traffic Services (VTS); and 9.1-9.41 GHz covering marine navigation radars, both shore-based and aboard civil/military small/large craft. In practise, a majority of the objections to proposed wind farm installations are raised by the operators of these radar types and it is highly probable that the same frequencies will be critical in other non-UK wind farm construction projects.

The predictions of backscatter generated by MITRE and FEKO for the tower were compared against those calculated using simple geometric optics-derived formulae for a similarly shaped component represented as simple shapes.

There are a number of known methods for evaluating RCS for simple structures such as that of a wind turbine tower. In particular, the text book "Radar Cross Section", by E. F. Knott, J. F. Shaeffer, M. T. Tuley, Second Edition, Artech House, 1993, describes a general method for predicting RCS. Features of the "MITRE" software referred to above are described in a paper by A M Woods, C D Sillence and K D Carmody, entitled "Efficient Radar Cross Section Calculations on Airframe Geometries at High Frequencies", Proc. Second Test and Evaluation International Aerospace Forum, AIAA, London, 1996. However, irrespective of the technique used for evaluating RCS of a structure, the inventors in the present case have found that by adjusting the angle of inclination of a surface of a structure, for example a wind turbine tower that comprises a section that is conical in shape, the RCS of the structure may be minimised within the physical design constraints of the tower, or at least significantly reduced. The principles of RCS evaluation that demonstrate the beneficial effects of this shaping technique will now be described in outline with reference to FIG. 4.

Figure 4:
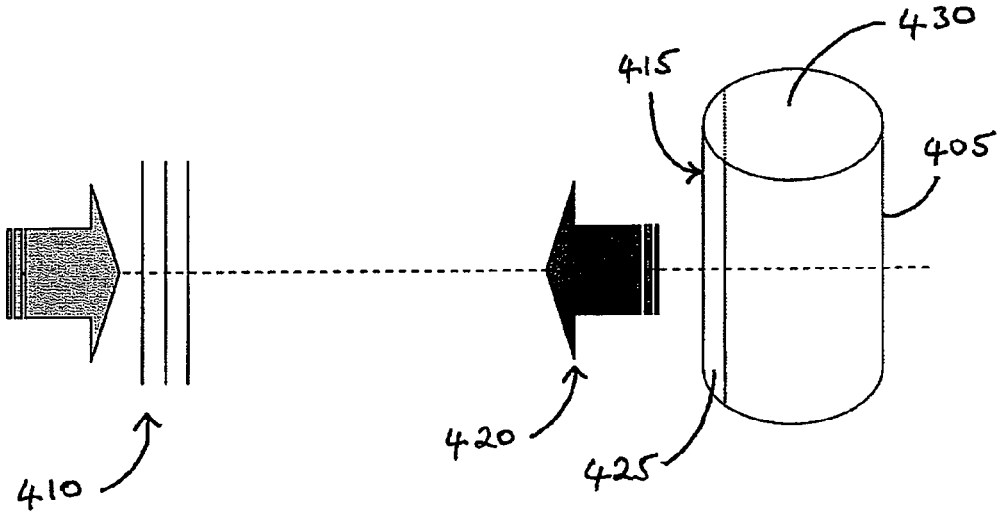
FIG. 4 illustrates the principles of backscattering of incident radar radiation by a cylindrical structure.

Referring to FIG. 4, if the structure is assumed to be a simple upright cylinder 405, and an illuminating radar signal 410 is incident on the cylinder 405 from a horizontal direction, the microwave energy of the radar signal 410 will arrive and be scattered in phase along an infinitely thin "line" 415 running all the way along the length of the cylinder 405. In practice, coherent scattering, as modelled using evaluation techniques based upon physical optics, is assumed to result from plane wave illumination of a surface where the curvature of the surface is such that the total phase variation (over that surface) in a reflected wave 420 is less than one eighth of a wavelength—the so termed "Stationary Phase Zone". This zone forms a band 425 whose extent around the cylinder 405 either side of the "line" 415 varies as a function of frequency, being wider at low frequencies. The width of this band 425 may be determined by conventional techniques, such as those referenced above, at each of the frequency bands of interest. However, the inventors in the above-referenced case have found that if the angle of the incident radar wave 410 is changed slightly so that the incident radiation is no longer normally incident but is elevated or depressed, then specular scattering from the cylinder 405 no longer reaches the receiving aperture of the radar. The scattering is then governed by returns from the sidelobes in the scattered radiation. Within an overall sidelobe envelope, the sidelobes are periodic with increasing angle from normal incidence and hence at some angles the RCS may be significantly lower than at other angles that differ by only a fraction of a degree. The periodicity of the sidelobes is governed by discontinuities in the currents induced on the surface of the cylinder 405, in this example caused by the ends 430 of the cylinder. Hence, long cylinders yield very narrow sidelobes with high periodicity with increasing angle, while short cylinders yield wide sidelobes with low periodicity. A typical sidelobe envelope and periodic sidelobe pattern for a cylinder is shown in FIG. 5.

Figure 5:
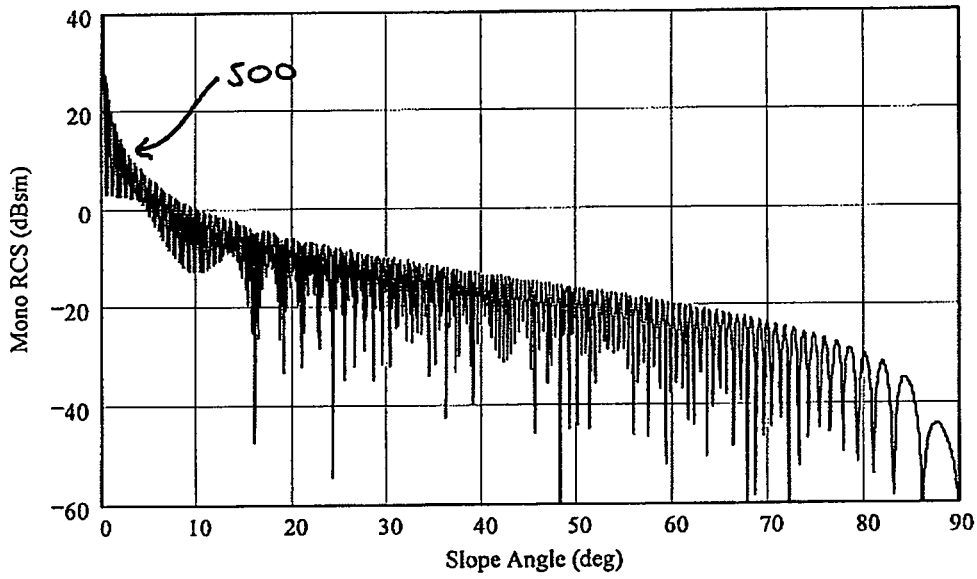
FIG. 5 is a graph showing a typical sidelobe pattern in backscattered radiation by an electrically large cylinder at varying angles of inclination.

Referring to FIG. 5, it can be seen from the steeply sloping section 500 of the sidelobe envelope that even a small angle of inclination from normal incidence, of only one or two degrees, results in a significant reduction in RCS.

However, as will be emphasised below and as can be seen from FIG. 5, within the overall sidelobe envelope the periodic sidelobe pattern varies significantly with very small variations in angle of inclination, providing an opportunity, in a preferred embodiment of the present invention, for fine tuning of RCS through careful choice of angle. These effects occur similarly if, instead of tilting the angle of illuminating radiation of a cylinder 405 by a small angle away from normal incidence, the illumination remains horizontal but the sides of the cylinder are sloped to form a cone. In this case the RCS differs somewhat as the radius varies linearly along the length of the cone in addition to the effect on the RCS of a transverse electromagnetic wave being off-normal.

The inventors of this technique have developed a simple mathematical routine, based to some extent on principles described in the published references cited above, to predict the RCS of a wind turbine tower as a function of frequency and angle, i.e. for a tower comprising a truncated cone portion supported on top of a cylindrical portion. By careful selection of the cone and cylinder heights and the cone angle, the present inventors have demonstrated that it is possible to ensure that the radar cross section of the tower, from the perspective of a particular radar receiving aperture, is minimised or at least significantly reduced for the two preferred frequency bands mentioned above. This is achieved by ensuring that illumination of the cone portion from the horizontal direction at both those frequency bands results in scattered radiation at or near respective minima in the sidelobe pattern within the sidelobe envelope. This gives rise to a greater reduction in RCS than would be achieved by simply altering the geometry of a tower from a simple cylinder to a cone of arbitrary slope angle. In that instance, the arbitrarily chosen slope angle may correspond to a sidelobe maximum being detected at the radar receiving aperture rather than a minimum in the sidelobe pattern.

In summary, the reductions in radar cross section achievable by this technique, relative to the RCS of a simple cylinder, are of two types. Firstly, conversion of the simple cylinder into a truncated cone of an arbitrary cone angle, typically of 1 or 2 degrees, results in a significant reduction in the radar cross section consistent with the overall sidelobe envelope. Secondly, the sidelobe radiation pattern within that sidelobe envelope consists of a series of maxima and minima as described previously and hence the RCS can be further reduced, from the perspective of a particular radar receiving aperture, if a cone angle is chosen so that radiation scattered from the cone and detected by the radar is at or near a minimum in the sidelobe pattern at the frequency bands of interest. This is possible because the variation in periodicity of the sidelobes with cone angle is frequency dependent. This variation in periodicity and other aspects will now be demonstrated and described with reference to FIGS. 6, 7 and 8. These figures are provided in the context of an existing design of wind turbine tower having a cylindrical portion and a conical portion in the proportion 54 m to 24 m respectively.

Figure 6:
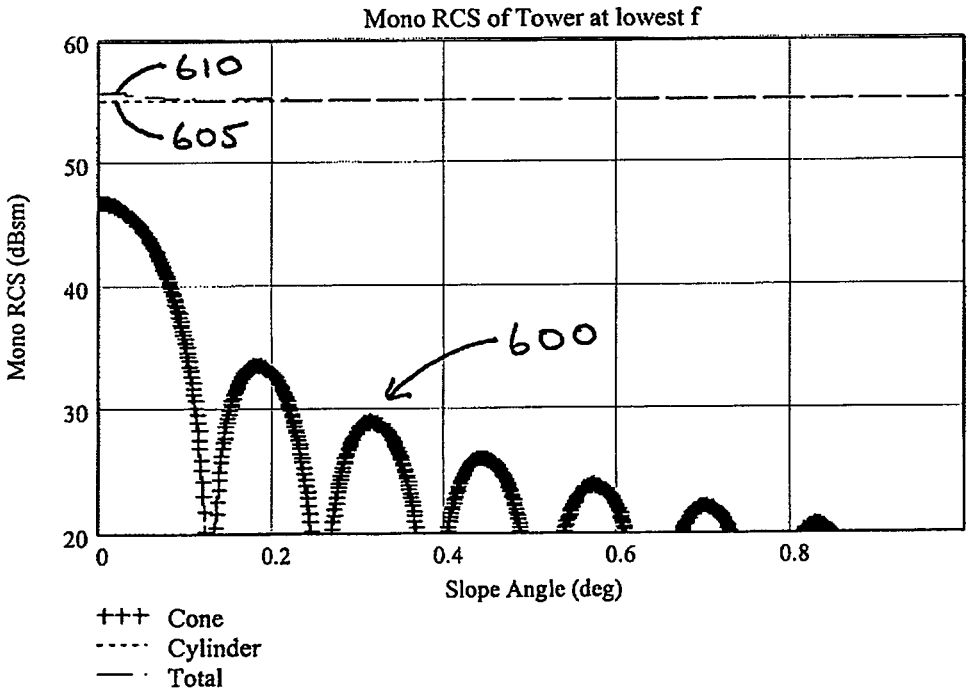
FIG. 6 shows how the RCS (at 3 GHz) of a conventional wind turbine tower may be varied through changes to the shape of a conical portion of the tower according to preferred embodiments of the present invention.

Referring firstly to FIG. 6, assuming illumination by radiation of a frequency of 3 GHz—the lower of the two radar bands of interest—three graphs 600, 605 and 610 of RCS are provided. The graph 600 shows how the RCS (sidelobe pattern) of the smaller conical portion of the tower would vary if its slope angle were to be varied between 0° and 1°. The graph 605 shows the RCS of the cylindrical portion as being fixed at approximately 56 dBsm; the cylinder surface being of fixed slope. The graph 610 shows how the total RCS for the tower would vary if the slope angle of the conical portion were varied between 0° and 1°, taking account of the contributions from the cylindrical portion and the conical portion. It can be seen that for a wind turbine tower according to an existing design, where the cylindrical portion is significantly longer than the conical portion, the total RCS of the tower reduces only slightly as the slope of the conical portion is increased from 0° to 0.2° but negligibly thereafter. However, FIG. 6 does emphasise that if the tower can be designed so as to comprise as great a proportion as possible in the form of a cone, the RCS of the tower would reduce much more considerably with increasing slope angle of the cone, in the limit corresponding to a plot similar to that shown in the graph 600 if the tower were to comprise only a conical portion.

Figure 7:
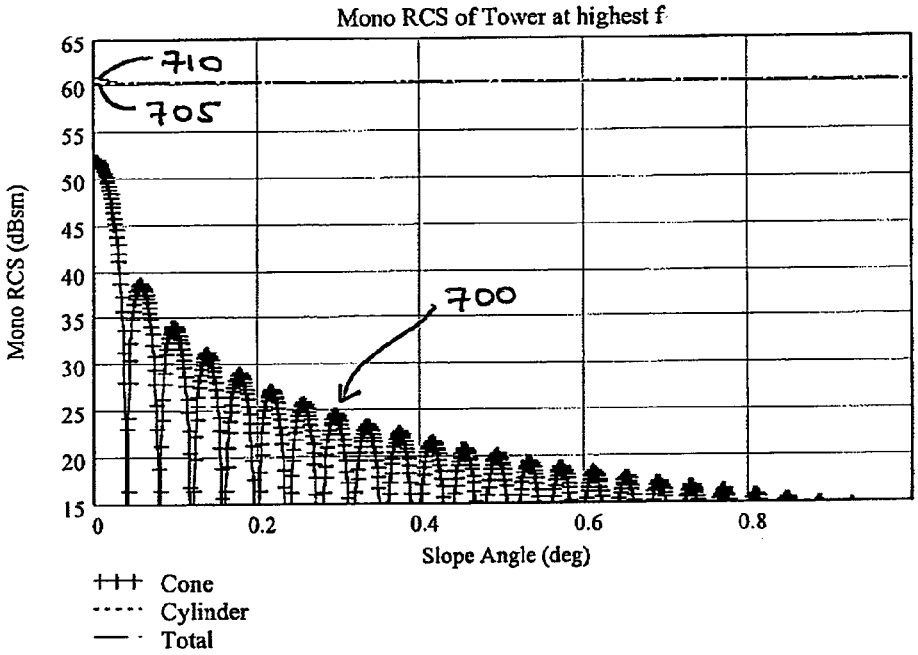
FIG. 7 shows how the RCS (at 10 GHz) of a conventional wind turbine tower may be varied through changes to the shape of a conical portion of the tower according to preferred embodiments of the present invention.

Referring to FIG. 7, a similar set of graphs 700, 705 and 710 are provided to those of FIG. 6 in respect of the same tower design, on the basis of illumination by radiation of frequency 10 GHz—approximating the higher of the two radar bands of interest. It can be seen, in particular, by comparing the periodicity in the sidelobe pattern 600 of FIG. 6 with the pattern 700 of FIG. 7, that the periodicity in the sidelobe pattern relating to the conical portion increases with increasing frequency of illuminating radiation. This provides an opportunity for finding an optimal slope angle corresponding to sidelobe minima at two different frequencies.

Figure 8:
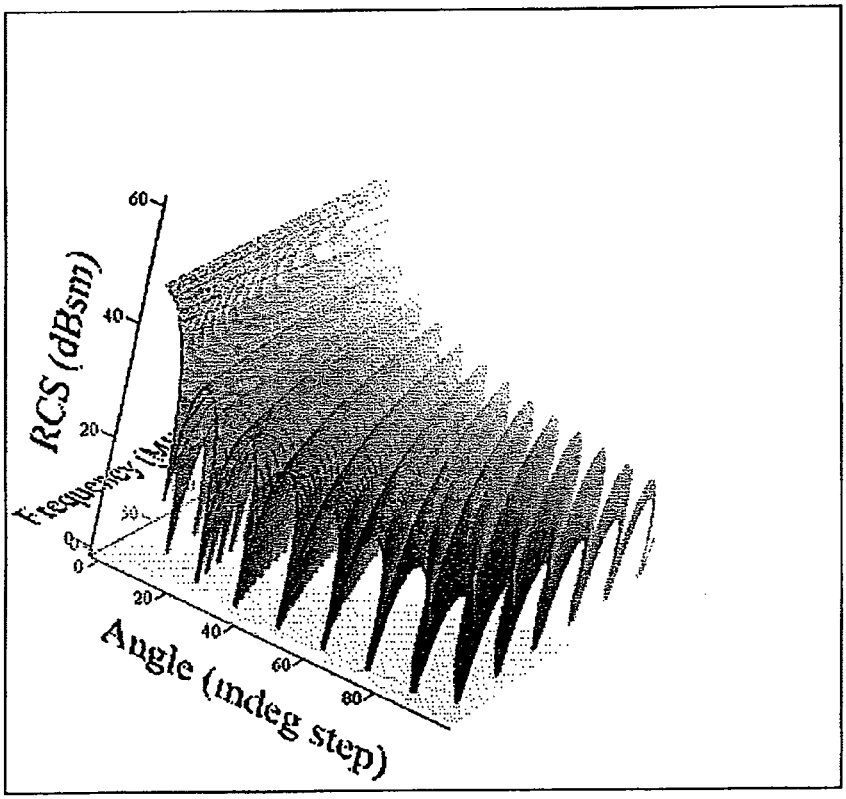
FIG. 8 is a 2D plot showing how the RCS of the conical portion of a tower varies with both angle of inclination and frequency.

Referring to FIG. 8, a 2D plot is provided showing how RCS varies with slope angle of the conical portion of a tower and with frequency, showing in particular the increase in periodicity of the sidelobe pattern of scattered radiation with increasing illumination frequency.

In practice, a preferred process for designing a tower or a structure such as an enclosure according to preferred embodiments of the present invention having minimal overall (e.g. mean) RCS at one or more frequencies, would use RCS graphs similar to those generated in FIG. 6, 7 or 8 through modelling of the structure with known RCS evaluation techniques as described and referenced above. However, taking account of practical constraints in the configuration of a tower, in particular, the graphs 600 and 700 in FIGS. 6 and 7 respectively may be converted to show the variation of RCS for a conical portion in terms of the base diameter of the cone, rather than in terms of the angle of slope, for each frequency of interest. The converted graphs may then be shown on the same plot in order to identify an optimal base diameter (slope angle) for the cone, as shown for example in FIG. 9.

Figure 9:
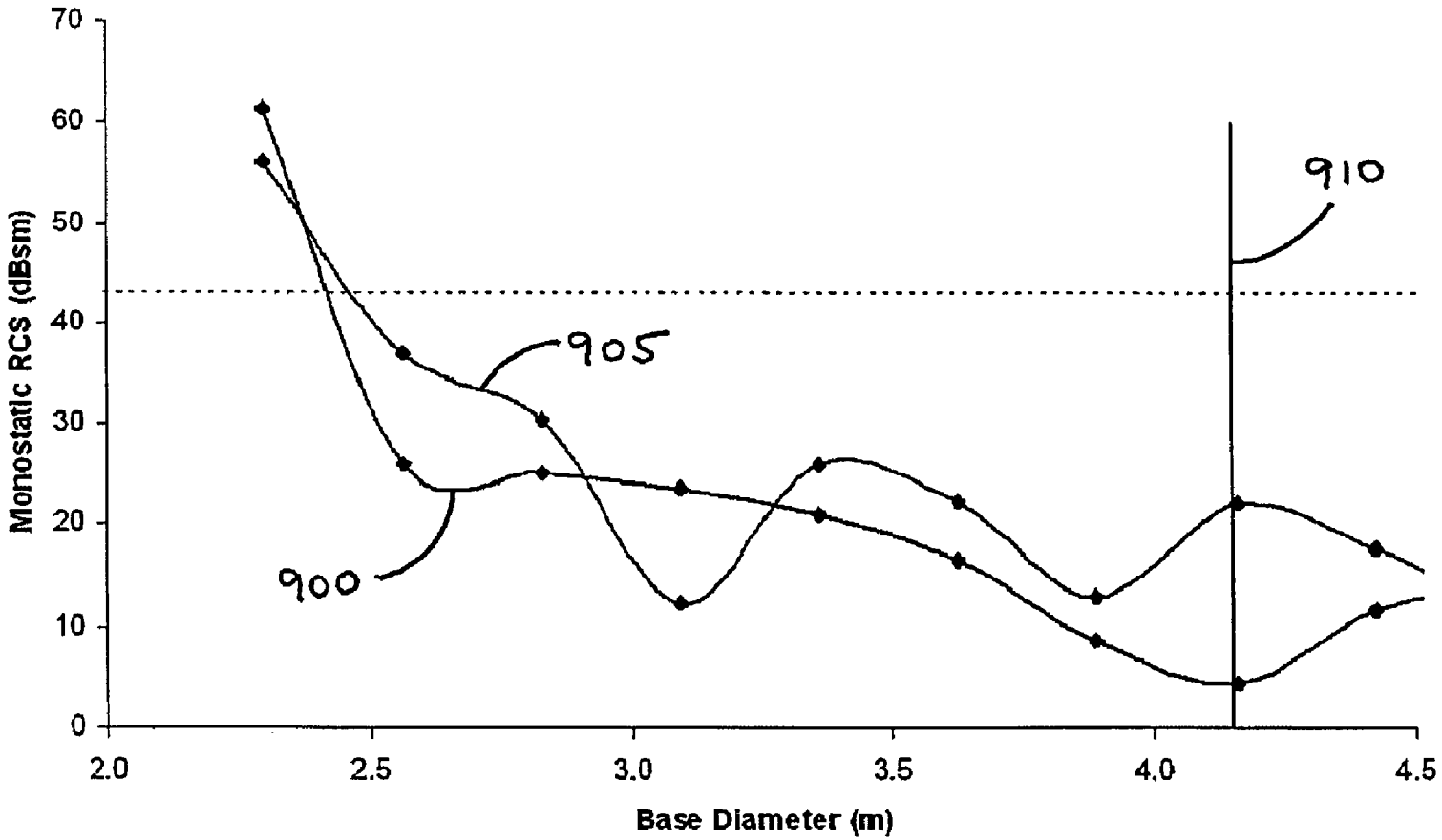
FIG. 9 shows plots of the RCS of a conical portion of a tower at two different frequencies for the purpose of finding an optimum base diameter and hence slope angle according to preferred embodiments of the present invention.

Referring to FIG. 9, a graph 900 of RCS for a cone for 3 GHz radar and a graph 905 of RCS for a cone for 10 GHz radar are shown. It is a relatively simple exercise to identify an optimal base diameter 910 for the cone, in this example at approximately 4.15 m, corresponding to a slope angle of approximately 0.6°, if necessary within a practically convenient range of diameters, that results in a minimal overall RCS. FIG. 9 demonstrates that it is possible to construct a tower, in particular a wind turbine tower, comprised only of a truncated cone that with slope angle chosen according the method described above minimises radar cross-section at both the main radar frequency bands in the UK. Of course, equivalent graphs may be generated for typical enclosure structures that are less elongate than a typical tower structure in order to determine the most appropriate angle for inclination of surfaces at one or more radar frequency bands.

Preferably, an automated process may be implemented to identify the optimal base diameter/slope angle by the solution of simultaneous equations, one for each frequency, or by means of an iterative technique.

Whereas there may be scope for reducing the RCS of an existing structure by making a slight modification to a part of the structure, for example by altering the angle of slope of a conical section of the structure, or replacing that section, it may be that the dominant contribution to RCS arises from a part of the structure that cannot be economically changed. For example, if the cylindrical portion of an existing wind turbine tower is the dominant contributor to overall RCS, then subtle changes in the slope of a conical section supported by the cylinder may make little difference to the overall RCS of the tower. However, although an expensive solution for large structures, provision of an exterior metal cladding to create a more conical overall shape, at an angle of slope selected according to the present invention, may have a beneficial effect in reducing the overall RCS of the structure. Preferably the shaping of a structure according to the present invention may be combined with the use of radar absorbent materials, in particular when applied at least to that part of the structure making the largest contribution to the overall RCS of the structure, to further reduce the radar signature of the structure beyond that achievable through shaping alone.

Preferred embodiments of the present invention may be applied, potentially, to the enclosure of any object for which shaping is not a feasible or sufficient solution for significant RCS reduction.

The invention claimed is:

1. A structure for at least partially enclosing an object, comprising:

a non-metallic portion having a radar-reflective layer applied to an inclined surface of the structure, wherein the inclined surface is configured with at least one angle of inclination selected so that the radar cross-section for the structure has a value that is lower than that for the object in one or more frequency ranges; and a radar-reflective portion at least partially detached from the non-metallic portion of the structure, wherein the radar-reflective portion is provided with a surface inclined at one or more angles of inclination selected so that the radar cross-section for the structure has a value that is lower than that for the object in the one or more frequency ranges, and wherein the radar-reflective portion is provided on an interior side of the structure.

2. The structure according to claim 1, wherein the radar-reflective layer includes a metal foil applied to the inclined surface of the non-metallic portion of the structure.

3. The structure according to claim 2, wherein the metal foil is applied to an interior surface of the structure.

4. The structure according to claim 1, wherein the radar-reflective portion includes a flexible material with a metallic coating.

5. The structure according to claim 1, wherein the radar-reflective portion is supported by one or more ties attached to an interior surface of the structure.

6. The structure according to claim 1, wherein at least one of the at least one angle of inclination is selected to correspond to an angle for which the value for radar cross-section of the structure substantially corresponds to a local minimum in the pattern of sidelobes formed in a scattering pattern of incident electromagnetic radiation in at least one of said one or more frequency ranges.

7. A method for modifying an at least partial enclosure for an object, the method comprising:

applying a radar-reflective layer to the at least partial enclosure; and providing the enclosure with an inclined surface inclined at at least one angle of inclination selected so that the radar cross-section of the at least partial enclosure, so modified, has a value that is lower in comparison with that of the object in at least one frequency range;

wherein the at least partial enclosure presents a relatively small radar cross-section in comparison with that of the object, wherein the enclosure is non-metallic and the applying of the radar-reflective layer includes providing a radar-reflective structure at least partially detached from the non-metallic enclosure, and wherein the radar-reflective structure is provided with a surface inclined at one or more angles of inclination selected so that the radar cross-section of the at least partial enclosure, so modified, has a value that is lower in comparison with that of the object in the one or more frequency ranges.

8. The method of claim 7, wherein the enclosure is non-metallic and the applying of the radar-reflective layer includes applying a layer of metal foil to the inclined surface of the at least partial enclosure.

9. The method of claim 8, wherein the layer of metal foil is applied to an interior surface of the non-metallic enclosure.

10. The method according to claim 7, wherein the at least one angle of inclination is selected to correspond to an angle for which the value for radar cross-section of the structure, so modified, substantially corresponds to a local minimum in the pattern of sidelobes formed in a scattering pattern of incident electromagnetic radiation in the at least one frequency range.

11. A nacelle for a wind turbine, comprising:

a radar-reflective layer; and a non-metallic portion having an inclined surface to which the radar-reflective layer has been applied;

wherein the inclined surface includes at least one angle of inclination selected so that the radar cross-section for the nacelle has a value that is lower than that for equipment enclosed by the nacelle in at least one frequency rang, and wherein the radar-reflective layer includes a radar-reflective portion at least partially detached from the non-metallic portion of the nacelle and wherein the radar-reflective portion is provided with a surface inclined at one or more angles of inclination selected so that the radar cross-section for the nacelle has a value that is lower than that for the equipment in the at least one frequency range.

12. The nacelle according to claim 11, wherein the radar-reflective layer includes a metal foil applied to said inclined surface.

13. The nacelle according to 11, wherein the radar-reflective portion includes a flexible material having a metallic coating.

14. The nacelle according to Claim 11, wherein the radar-reflective portion is supported by at least one tie attached to an interior surface of the structure.

* * * * *